US010336427B1

(12) United States Patent
Ichikawa et al.

(10) Patent No.: US 10,336,427 B1
(45) Date of Patent: Jul. 2, 2019

(54) SYSTEM FOR AND METHOD OF OPERATING WATERCRAFT

(71) Applicant: YAMAHA HATSUDOKI KABUSHIKI KAISHA, Iwata-shi, Shizuoka (JP)

(72) Inventors: Noriyoshi Ichikawa, Shizuoka (JP); Akihiro Noma, Shizuoka (JP); Koei Kokubo, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/011,665

(22) Filed: Jun. 19, 2018

(30) Foreign Application Priority Data

Feb. 13, 2018 (JP) ..... 2018-023268

(51) Int. Cl.

| | |
|---|---|
| ***B63H 20/20*** | (2006.01) |
| ***B63H 25/24*** | (2006.01) |
| ***B63H 20/12*** | (2006.01) |
| ***B63H 20/00*** | (2006.01) |
| ***F02B 61/04*** | (2006.01) |
| ***F02D 41/02*** | (2006.01) |
| ***B63H 25/42*** | (2006.01) |

(52) U.S. Cl.
CPC ..... *B63H 20/20* (2013.01); *B63H 20/12* (2013.01); *B63H 21/265* (2013.01); *B63H 25/24* (2013.01); *B63H 25/42* (2013.01); *F02B 61/045* (2013.01); *F02D 41/021* (2013.01); *B63H 2020/003* (2013.01)

(58) Field of Classification Search
CPC ..... B63H 20/20; B63H 20/12
See application file for complete search history.

(56) References Cited

U.S. PATENT DOCUMENTS

| | | | | |
|---|---|---|---|---|
| 10,082,788 | B1 * | 9/2018 | Dengel | B63H 25/02 |
| 2008/0166932 | A1 * | 7/2008 | Kado | B63H 21/213 440/1 |
| 2008/0182464 | A1 * | 7/2008 | Kado | B63H 21/213 440/1 |
| 2014/0141663 | A1 * | 5/2014 | Kuriyagawa | B63H 20/20 440/1 |

FOREIGN PATENT DOCUMENTS

| | | | | |
|---|---|---|---|---|
| JP | 2014-100960 A | | 6/2014 | |
| JP | 2014100960 A | * | 6/2014 | B63H 20/20 |

* cited by examiner

*Primary Examiner* — S. Joseph Morano
*Assistant Examiner* — Jovon E Hayes
(74) *Attorney, Agent, or Firm* — Keating and Bennett, LLP

(57) ABSTRACT

A remote control outputs a remote control signal to operate an outboard motor. A joystick outputs a joystick signal to operate the outboard motor. A controller is configured or programmed to receive the remote control signal from the remote control and the joystick signal from the joystick, and to control shifting between forward movement and rearward movement by the outboard motor in response to operation of the remote control and the joystick. The controller executes first shift shock correction control when shifting between forward movement and rearward movement by the outboard motor in response to operation of the remote control. The controller executes second shift shock correction control different from the first shift shock correction control when shifting between forward movement and rearward movement by the outboard motor in response to operation of the joystick.

14 Claims, 8 Drawing Sheets

FIG. 6A

| ENGINE ROTATIONAL SPEED [rpm] | IGNITION TIMING CORRECTION [deg] |
|---|---|
| 500 | 0 |
| 600 | −20 |
| 800 | −20 |
| 900 | 0 |
| 1000 | 0 |
| 1100 | 0 |
| 1200 | 0 |
| 1300 | 0 |

R1

FIG. 6B

| ENGINE ROTATIONAL SPEED [rpm] | IGNITION TIMING CORRECTION [deg] |
|---|---|
| 500 | 0 |
| 600 | −20 |
| 800 | −20 |
| 900 | −20 |
| 1000 | −20 |
| 1100 | −20 |
| 1200 | −20 |
| 1300 | −20 |

R2

FIG. 8A

| | | ENGINE ROTATIONAL SPEED [rpm] | | | | | | |
|---|---|---|---|---|---|---|---|---|
| | | 600 | 1000 | 2000 | 3000 | 4000 | 5000 | 6000 |
| REQUIRED OPENING DEGREE [%] | 0 | 15% | 15% | 15% | 15% | 15% | 15% | 15% |
| | 10 | 15% | 15% | 15% | 15% | 15% | 15% | 15% |
| | | | | | | | | |
| | 80 | 20% | 20% | 20% | 20% | 20% | 20% | 20% |
| | 90 | 20% | 20% | 20% | 20% | 20% | 20% | 20% |

FIG. 8B

| | | ENGINE ROTATIONAL SPEED [rpm] | | | | | | |
|---|---|---|---|---|---|---|---|---|
| | | 600 | 1000 | 2000 | 3000 | 4000 | 5000 | 6000 |
| REQUIRED OPENING DEGREE [%] | 0 | 12% | 12% | 12% | 12% | 12% | 12% | 12% |
| | 10 | 12% | 12% | 12% | 12% | 12% | 12% | 12% |
| | | | | | | | | |
| | 80 | 16% | 16% | 16% | 16% | 16% | 16% | 16% |
| | 90 | 16% | 16% | 16% | 16% | 16% | 16% | 16% |

SYSTEM FOR AND METHOD OF OPERATING WATERCRAFT

CROSS REFERENCE TO RELATED APPLICATIONS

This application claims the benefit of priority to Japanese Patent Application No. 2018-023268 filed on Feb. 13, 2018. The entire contents of this application are hereby incorporated herein by reference.

BACKGROUND OF THE INVENTION

1. Field of the Invention

The present invention relates to a system for and a method of operating a watercraft including an outboard motor.

2. Description of the Related Art

It has been known that shift shock (sound, impact, etc.) occurs when a watercraft operator uses a remote control to operate shifting between forward movement and rearward movement by an outboard motor. Japan Laid-open Patent Application Publication No. 2014-100960 discloses a technology that a controller of an outboard motor executes control such as a delay in ignition timing so as to reduce the engine rotational speed of the outboard motor, whereby shift shock is lessened.

Operating an outboard motorboat not with the remote control but with a joystick has been known in recent years. Chances are that the engine rotational speed becomes high when operating with the joystick. In this case, shift shock becomes large in shifting between forward movement and rearward movement by the outboard motor. In view of this, improvement has been demanded for lessening shift shock in operation with the joystick.

SUMMARY OF THE INVENTION

Watercraft operating systems to operate watercraft including outboard motors according to preferred embodiments of the present invention include a remote control, a joystick, and a controller. The remote control outputs a remote control signal to operate the outboard motor. The joystick outputs a joystick signal to operate the outboard motor. The controller is configured or programmed to receive the remote control signal from the remote control and receive the joystick signal from the joystick. The controller is further configured or programmed to control shifting between forward movement and rearward movement by the outboard motor in response to operation of the remote control and the joystick. The controller is configured or programmed to execute first shift shock correction control when shifting between forward movement and rearward movement by the outboard motor in response to operation of the remote control. The controller is configured or programmed to execute second shift shock correction control different from the first shift shock correction control when shifting between forward movement and rearward movement by the outboard motor in response to operation of the joystick.

In a watercraft operating system according to a preferred embodiment of the present invention, the second shift shock correction control, which is different from the first shift shock correction control executed during shifting between forward movement and rearward movement by the outboard motor in response to operation of the remote control, is executed when shifting between forward movement and rearward movement by the outboard motor in response to operation of the joystick. Accordingly, shift shock is significantly reduced or prevented when operating the joystick.

Methods executed by a controller to operate a watercraft including an outboard motor according to preferred embodiments of the present invention include the following processes. A first process includes receiving a remote control signal to operate the outboard motor from a remote control. A second process includes receiving a joystick signal to operate the outboard motor from a joystick. A third process includes controlling shifting between forward movement and rearward movement by the outboard motor in response to operation of the remote control and the joystick. A fourth process includes executing first shift shock correction control when shifting between forward movement and rearward movement by the outboard motor in response to operation of the remote control. A fifth process includes executing second shift shock correction control, different from the first shift shock correction control, when shifting between forward movement and rearward movement by the outboard motor in response to operation of the joystick.

In a method according to a preferred embodiment of the present invention, the second shift shock correction control, which is different from the first shift shock correction control executed when shifting between forward movement and rearward movement by the outboard motor in response to operation of the remote control, is executed when shifting between forward movement and rearward movement by the outboard motor in response to operation of the joystick. Accordingly, shift shock is significantly reduced or prevented when operating the joystick.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 6A and 6B include tables showing an example of first shift shock correction data and second shift shock correction data.

FIGS. 8A and 8B include tables showing an example of first dashpot correction data and second dashpot correction data.

DETAILED DESCRIPTION OF THE PREFERRED EMBODIMENTS

Figure 1:
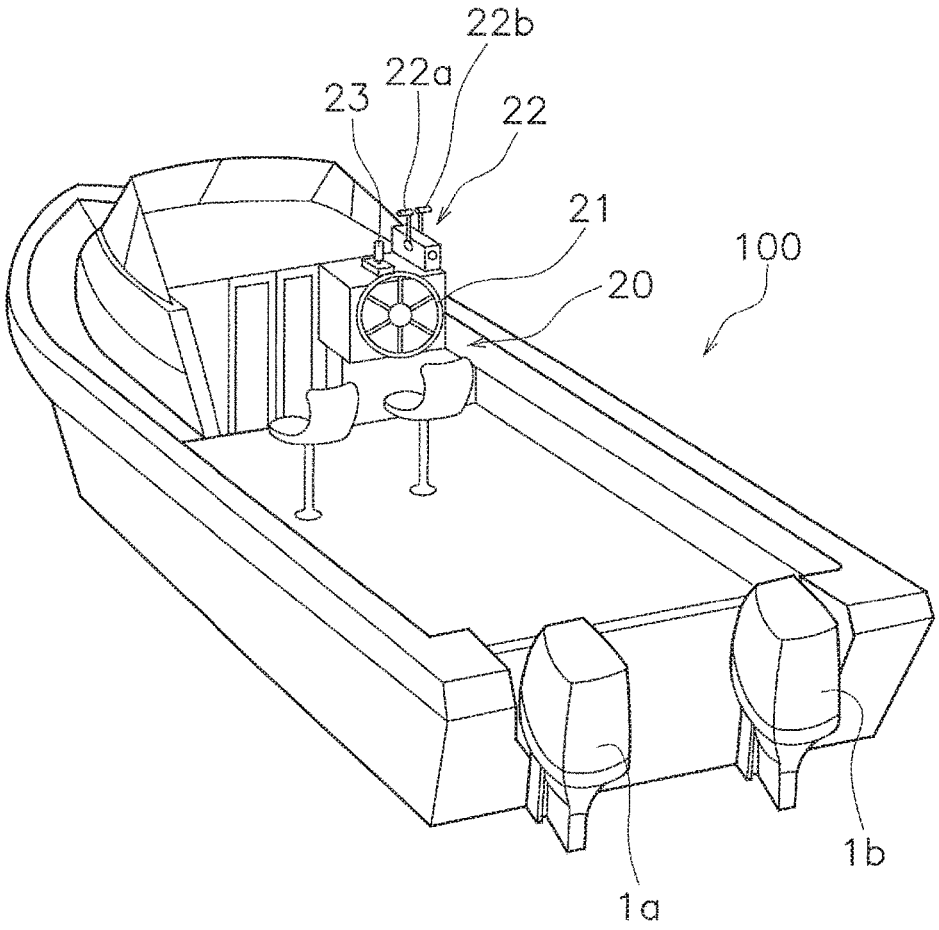
FIG. 1 is a perspective view of a watercraft to which a watercraft operating system according to a preferred embodiment of the present invention is mounted.

Preferred embodiments of the present invention will be hereinafter explained with reference to the attached drawings. FIG. 1 is a perspective view of a watercraft 100 to which a watercraft operating system according to a preferred embodiment of the present invention is mounted. The watercraft 100 includes a plurality of outboard motors. More specifically, the watercraft 100 includes a left outboard motor 1*a* and a right outboard motor 1*b*.

The outboard motors 1*a* and 1*b* are attached to the stern of the watercraft 100. The outboard motors 1*a* and 1*b* are aligned in the width direction of the watercraft 100. Specifically, the left outboard motor 1*a* is disposed on the port side of the watercraft 100. The right outboard motor 1*b* is disposed on the starboard side of the watercraft 100. Each of the outboard motors 1*a* and 1*b* generates a thrust to propel the watercraft 100.

Figure 2:
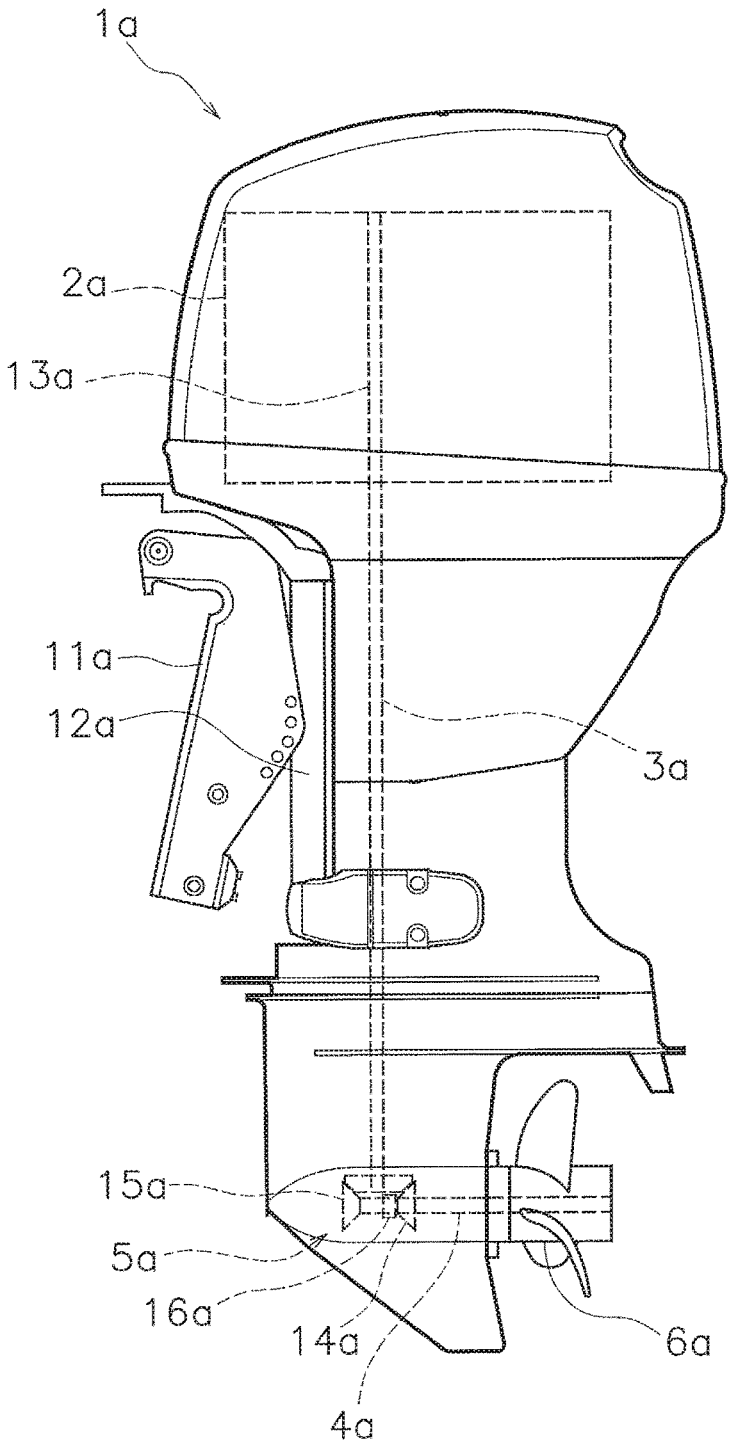
FIG. 2 is a side view of an outboard motor.

FIG. 2 is a side view of the left outboard motor 1*a*. A structure of the left outboard motor 1*a* will be hereinafter explained. However, the right outboard motor 1*b* preferably has a similar structure to the left outboard motor 1*a*. The left outboard motor 1*a* is attached to the watercraft 100 through a bracket 11*a*. The bracket 11*a* supports the left outboard motor 1*a* such that the left outboard motor 1*a* is rotatable about a steering shaft 12*a*. The steering shaft 12*a* extends in the vertical direction.

The left outboard motor 1*a* includes an engine 2*a*, a drive shaft 3*a*, a propeller shaft 4*a*, and a shift mechanism 5*a*. The engine 2*a* generates the thrust to propel the watercraft 100. The engine 2*a* includes a crankshaft 13*a*. The crankshaft 13*a* extends in the vertical direction. The drive shaft 3*a* is connected to the crankshaft 13*a*. The drive shaft 3*a* extends in the vertical direction. The propeller shaft 4*a* extends in the back-and-forth direction. The propeller shaft 4*a* is connected to the drive shaft 3*a* through the shift mechanism 5*a*. A propeller 6*a* is attached to the propeller shaft 4*a*.

The shift mechanism 5*a* includes a forward moving gear 14*a*, a rearward moving gear 15*a*, and a dog clutch 16*a*. When gear engagement is switched between the gears 14*a* and 15*a* by the dog clutch 16*a*, the direction of rotation transmitted from the drive shaft 3*a* to the propeller shaft 4*a* is switched. Movement of the watercraft 100 is thus switched between forward movement and rearward movement.

Figure 3:
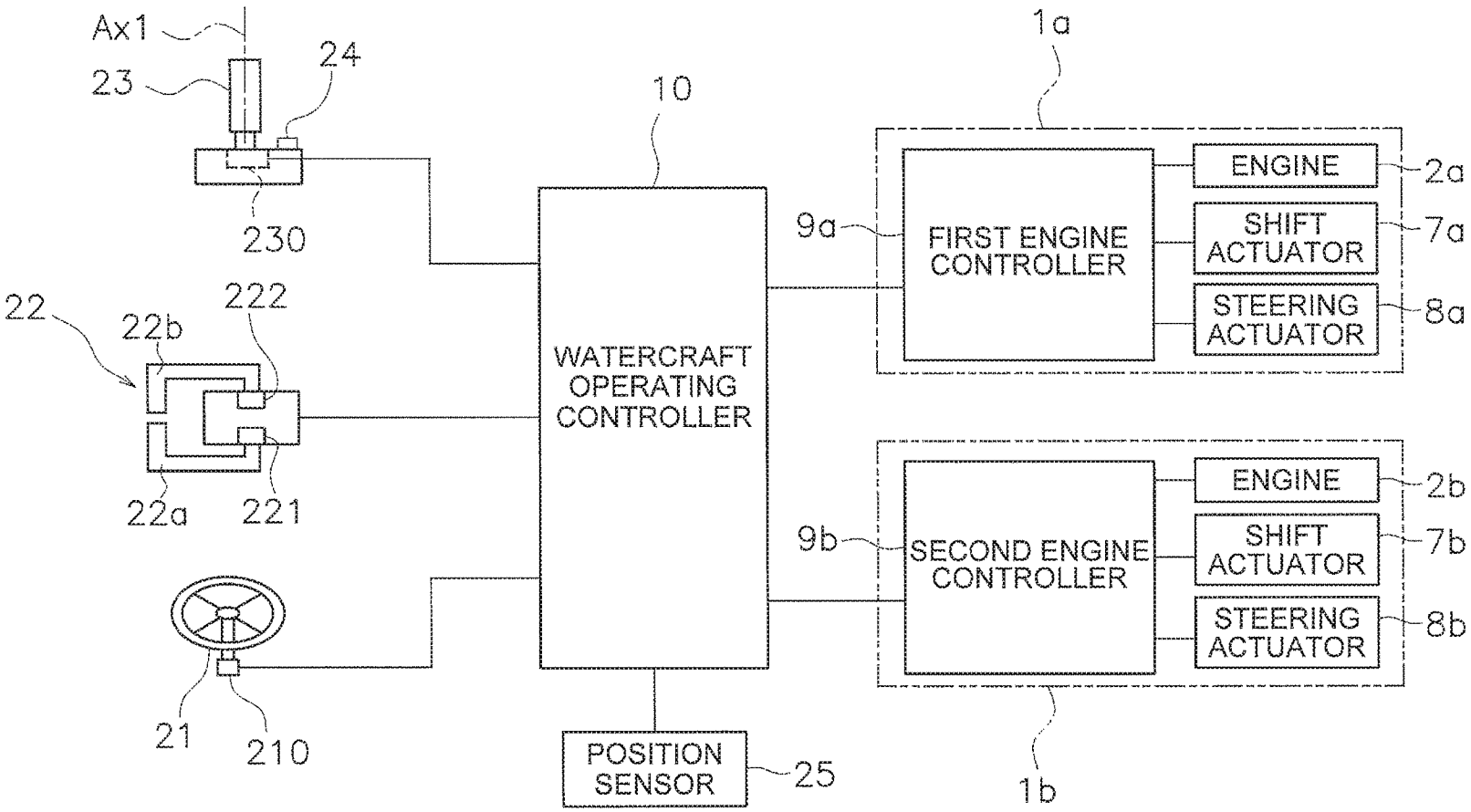
FIG. 3 is a block diagram showing a configuration of the watercraft operating system.

FIG. 3 is a schematic diagram showing a configuration of the watercraft operating system for the watercraft 100. As shown in FIG. 3, the left outboard motor 1*a* includes a shift actuator 7*a* and a steering actuator 8*a*.

The shift actuator 7*a* is connected to the dog clutch 16*a* of the shift mechanism 5*a*. The shift actuator 7*a* actuates the dog clutch 16*a* so as to switch gear engagement between the gears 14*a* and 15*a*. Movement of the watercraft 100 is thus switched between forward movement and rearward movement. The shift actuator 7*a* is, for instance, an electric motor. It should be noted that the shift actuator 7*a* may be another type of actuator such as an electric cylinder, a hydraulic motor, or a hydraulic cylinder.

The steering actuator 8*a* is connected to the left outboard motor 1*a*. The steering actuator 8*a* rotates the left outboard motor 1*a* about the steering shaft 12*a*. The rudder angle of the left outboard motor 1*a* is thus changed. The steering actuator 8*a* is, for instance, an electric motor. It should be noted that the shift actuator 7*a* may be another type of actuator such as an electric cylinder, a hydraulic motor, or a hydraulic cylinder.

The left outboard motor 1*a* includes a first engine controller 9*a*. The first engine controller 9*a* includes a processor such as a CPU and memories such as a RAM and a ROM. The first engine controller 9*a* is configured or programmed to store programs and data to control the left outboard motor 1*a*. The first engine controller 9*a* controls actions of the engine 2*a*, the shift actuator 7*a*, and the steering actuator 8*a*.

Figure 4:
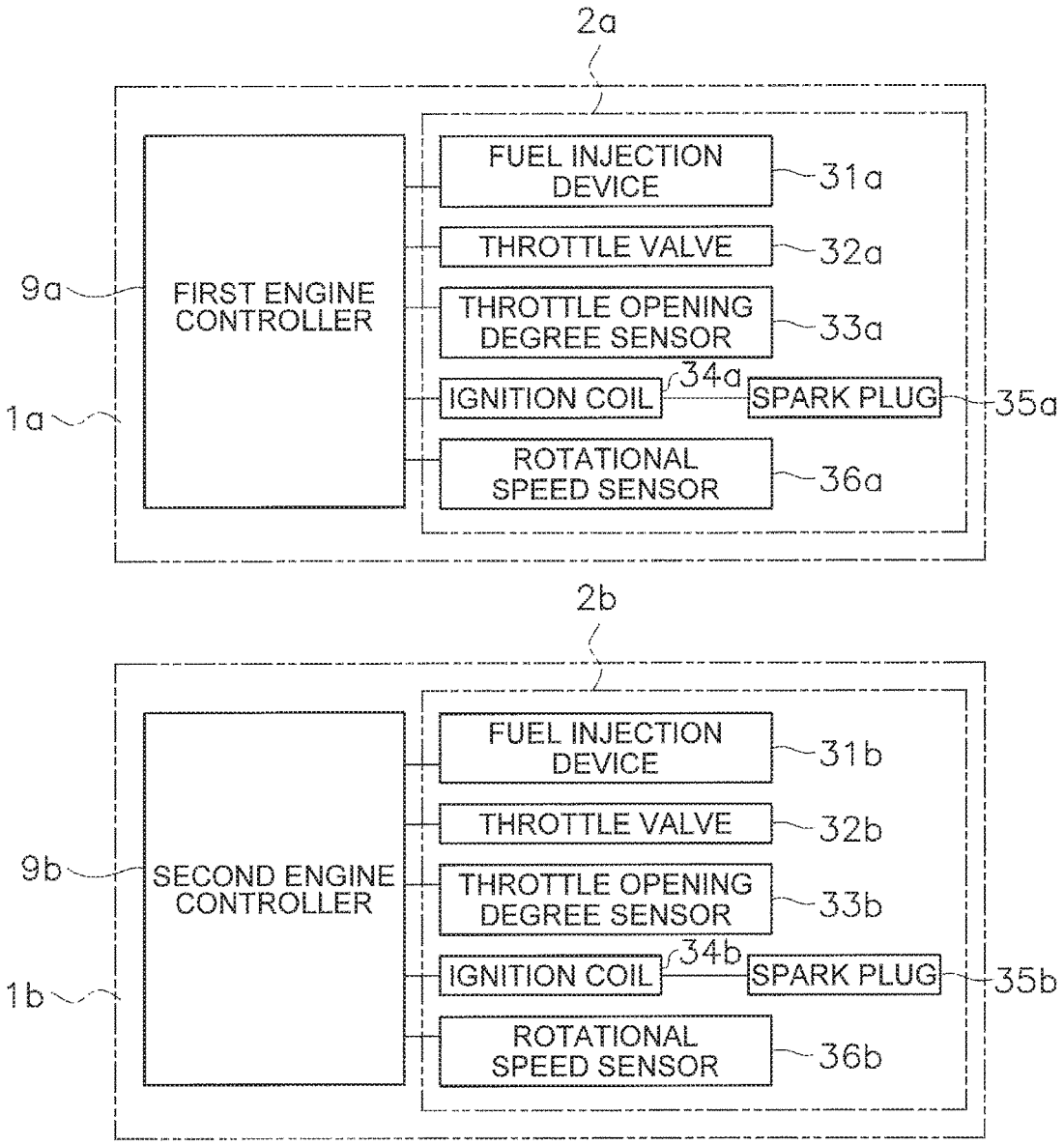
FIG. 4 is a block diagram showing a control system of an engine.

FIG. 4 is a block diagram showing a control system of the engine 2*a*. As shown in FIG. 4, the engine 2*a* includes a fuel injection device 31*a*, a throttle valve 32*a*, and a throttle opening degree sensor 33*a*. The fuel injection device 31*a* injects fuel into a combustion chamber of the engine 2*a*. The first engine controller 9*a* is in communication with the fuel injection device 31*a*. The first engine controller 9*a* controls the fuel injection device 31*a* by outputting a command signal to the fuel injection device 31*a*.

The throttle valve 32*a* opens and closes an intake pathway of the engine 2*a*. The throttle opening degree sensor 33*a* outputs a signal indicating the opening degree of the throttle valve 32*a*. The throttle valve 32*a* and the throttle opening degree sensor 33*a* are in communication with the first engine controller 9*a*. The first engine controller 9*a* controls the opening degree of the throttle valve 32*a* by outputting a command signal to the throttle valve 32*a*.

The engine 2*a* includes an ignition coil 34*a*, a spark plug 35*a*, and a rotational speed sensor 36*a*. The ignition coil 34*a* supplies electric power to the spark plug 35*a*. The spark plug 35*a* generates an electric spark in the combustion chamber of the engine 2*a* so as to ignite an air-fuel mixture therein. The ignition coil 34*a* is in communication with the first engine controller 9*a*. The first engine controller 9*a* controls the ignition coil 34*a* so as to control ignition of the spark plug 35*a* at a predetermined timing. The predetermined timing is, for instance, a position of a crank angle of several degrees before the dead center. The predetermined timing may be determined in accordance with a change in temperature of the engine 2*a*, a period of time elapsed since start of the engine 2*a*, or so forth.

The rotational speed sensor 36*a* is, for instance, a crank angle sensor that generates a pulse signal in accordance with rotation of the crankshaft 13*a* of the engine 2*a*. The first engine controller 9*a* receives the signal from the rotational speed sensor 36*a*. The first engine controller 9*a* calculates the engine rotational speed based on the signal received from the rotational speed sensor 36*a*.

As shown in FIG. 3, the right outboard motor 1*b* includes an engine 2*b*, a shift actuator 7*b*, a steering actuator 8*b*, and a second engine controller 9*b*. The engine 2*b*, the shift actuator 7*b*, the steering actuator 8*b*, and the second engine controller 9*b* in the right outboard motor 1*b* are preferably similar to the engine 2*a*, the shift actuator 7*a*, the steering actuator 8*a*, and the first engine controller 9*a* in the left outboard motor 1*a*, respectively.

As shown in FIG. 4, the engine 2*b* includes a fuel injection device 31*b*, a throttle valve 32*b*, a throttle opening degree sensor 33*b*, an ignition coil 34*b*, a spark plug 35*b*, and a rotational speed sensor 36*b*. The fuel injection device 31*b*, the throttle valve 32*b*, the throttle opening degree sensor 33*b*, the ignition coil 34*b*, the spark plug 35*b*, and the rotational speed sensor 36*b* in the engine 2*b* are preferably similar to the fuel injection device 31*a*, the throttle valve 32*a*, the throttle opening degree sensor 33*a*, the ignition coil 34*a*, the spark plug 35*a*, and the rotational speed sensor 36*a* in the engine 2*a*, respectively.

As shown in FIG. 3, the watercraft operating system includes a steering wheel 21, a remote control 22, and a joystick 23. As shown in FIG. 1, the steering wheel 21, the remote control 22, and the joystick 23 are disposed in a cockpit 20 of the watercraft 100.

The steering wheel 21 allows a watercraft operator to operate the turning direction of the watercraft 100. The steering wheel 21 includes a sensor 210. The sensor 210 outputs a steering signal indicating the operating direction and the operating amount of the steering wheel 21.

The remote control 22 includes a first throttle lever 22*a* and a second throttle lever 22*b*. The first throttle lever 22*a* allows the watercraft operator to regulate the magnitude of the thrust generated by the left outboard motor 1*a*. The first throttle lever 22*a* allows the watercraft operator to switch the direction of the thrust generated by the left outboard motor 1*a* between forward and rearward directions. The first throttle lever 22*a* is operable from a neutral position to a forward moving directional side and a rearward moving directional side. The neutral position is a position located between the forward moving directional side and the rearward moving directional side. The first throttle lever 22*a* includes a sensor 221. The sensor 221 outputs a remote control signal indicating the operating direction and the operating amount of the first throttle lever 22*a*.

The second throttle lever 22*b* allows the watercraft operator to regulate the magnitude of the thrust generated by the right outboard motor 1*b*. The second throttle lever 22*b* allows the watercraft operator to switch the direction of the thrust generated by the right outboard motor 1*b* between forward and rearward directions. The second throttle lever 22*b* is preferably similar to the first throttle lever 22*a*. The second throttle lever 22*b* includes a sensor 222. The sensor 222 outputs a remote control signal indicating the operating direction and the operating amount of the second throttle lever 22*b*.

The joystick 23 allows the watercraft operator to operate the movement of the watercraft 100 in each of the moving directions of front, rear, right, and left. The joystick 23 allows the watercraft operator to operate the bow turning motion of the watercraft 100. The joystick 23 is tiltable at least in four directions of front, rear, right, and left. It should be noted that the joystick 23 may instruct the watercraft 100 to move in four or more directions, or all directions.

Moreover, the joystick 23 is turnable about a rotational axis Ax1. The joystick 23 includes a sensor 230. The sensor 230 outputs a joystick signal indicating the tilt direction and the tilt amount of the joystick 23. Additionally, the sensor 230 outputs a joystick signal indicating the twist direction and the twist amount of the joystick 23.

The watercraft operating system includes a watercraft operating controller 10. The watercraft operating controller 10 includes a processor such as a CPU and memories such as a RAM and a ROM. The watercraft operating controller 10 is configured or programmed to store programs and data to control the right and left outboard motors 1*b* and 1*a*. The watercraft operating controller 10 is connected to the first and second engine controllers 9*a* and 9*b* through wired or wireless communication. The watercraft operating controller 10 is connected to the steering wheel 21, the remote control 22, and the joystick 23 through wired or wireless communication.

The watercraft operating controller 10 receives the steering signal from the sensor 210. The watercraft operating controller 10 receives the remote control signals from the sensors 221 and 222. The watercraft operating controller 10 receives the joystick signal from the sensor 230. The watercraft operating controller 10 outputs command signals to the first and second engine controllers 9*a* and 9*b* based on the signals from the sensors 210, 221, 222, and 230.

For example, the watercraft operating controller 10 outputs a command signal to the shift actuator 7*a* in accordance with the operating direction of the first throttle lever 22*a*. In response, shifting is made between forward movement and rearward movement by the left outboard motor 1*a*. The watercraft operating controller 10 outputs a command signal to the engine 2*a* in accordance with the operating amount of the first throttle lever 22*a*. In response, the engine rotational speed of the left outboard motor 1*a* is controlled.

The watercraft operating controller 10 outputs a command signal to the shift actuator 7*b* in accordance with the operating direction of the second throttle lever 22*b*. In response, shifting is made between forward movement and rearward movement by the right outboard motor 1*b*. The watercraft operating controller 10 outputs a command signal to the engine 2*b* in accordance with the operating amount of the second throttle lever 22*b*. In response, the engine rotational speed of the right outboard motor 1*b* is controlled.

The watercraft operating controller 10 outputs command signals to the steering actuators 8*a* and 8*b* in accordance with the operating direction and the operating amount of the steering wheel 21. When the steering wheel 21 is operated leftward from the neutral position, the watercraft operating controller 10 controls the steering actuators 8*a* and 8*b* such that the left outboard motor 1*a* and the right outboard motor 1*b* are rotated rightward. The watercraft 100 thus turns leftward.

When the steering wheel 21 is operated rightward from the neutral position, the watercraft operating controller 10 controls the steering actuators 8*a* and 8*b* such that the left outboard motor 1*a* and the right outboard motor 1*b* are rotated leftward. The watercraft 100 thus turns rightward. Additionally, the watercraft operating controller 10 controls the rudder angle of the left outboard motor 1*a* and that of the right outboard motor 1*b* in accordance with the operating amount of the steering wheel 21.

The watercraft operating controller 10 outputs command signals to the engines 2*a* and 2*b*, the shift actuators 7*a* and 7*b*, and the steering actuators 8*a* and 8*b* in accordance with the tilt direction and the tilt amount of the joystick 23. The watercraft operating controller 10 controls the engines 2*a* and 2*b*, the shift actuators 7*a* and 7*b*, and the steering actuators 8*a* and 8*b* such that translation (linear motion) of the watercraft 100 is made at a velocity corresponding to the tilt amount of the joystick 23 in a direction corresponding to the tilt direction of the joystick 23.

More specifically, when the joystick 23 is tilted forward, the watercraft operating controller 10 moves the watercraft 100 forward (fore surge mode). When the joystick 23 is tilted rearward, the watercraft operating controller 10 moves the watercraft 100 rearward (aft surge mode). When the joystick 23 is tilted rightward or leftward, the watercraft operating controller 10 moves the watercraft 100 transversely rightward or leftward (sway mode).

The watercraft operating controller 10 controls the engines 2*a* and 2*b*, the shift actuators 7*a* and 7*b*, and the steering actuators 8*a* and 8*b* such that the watercraft 100 turns the bow at a velocity corresponding to the twist amount of the joystick 23 in a direction corresponding to the twist direction of the joystick 23 (bow turning mode).

The joystick 23 includes a mode setting switch 24. The watercraft operator is able to switch on and off a fixed spot keeping mode by operating the mode setting switch 24. When receiving the joystick signal, indicating that the fixed spot keeping mode has been turned on, from the mode setting switch 24, the watercraft operating controller 10 executes the fixed spot keeping mode such that the outboard motors are controlled to keep the watercraft 100 at a fixed position.

The watercraft operating system includes a position sensor 25. The position sensor 25 detects the position of the watercraft 100. The position sensor 25 is, for example, a GNSS (Global Navigation Satellite System) receiver such as a GPS (Global Positioning System) receiver. The position sensor 25 outputs a signal indicating the position of the watercraft 100.

The watercraft operating controller 10 is in communication with the position sensor 25. The watercraft operating controller 10 obtains the position of the watercraft 100 based on the signal received from the position sensor 25. In the fixed spot keeping mode, the watercraft operating controller 10 controls the engines 2*a* and 2*b*, the shift actuators 7*a* and 7*b*, and the steering actuators 8*a* and 8*b* so as to keep the watercraft 100 at a predetermined position. The predetermined position is, for instance, the position of the watercraft 100 at a point in time when the fixed spot keeping mode has been turned on. It should be noted that the predetermined position may be arbitrarily set.

When shifting between forward movement and rearward movement by each outboard motor 1*a*, 1*b* in response to operation of the remote control 22 or the joystick 23, each of the first and second engine controllers 9*a* and 9*b* executes shift shock correction control to significantly reduce or prevent shift shock. In the shift shock correction control, each of the first and second engine controllers 9*a* and 9*b* retards the ignition timing of each engine 2*a*, 2*b* from normal timing during shifting. Accordingly, the engine rotational speed is reduced, such that shift shock is significantly reduced or prevented. The shift shock correction control executed by the first engine controller 9*a* will be hereinafter explained. However, the second engine controller 9*b* also executes a series of processes similar to that executed by the first engine controller 9*a*.

Figure 5:
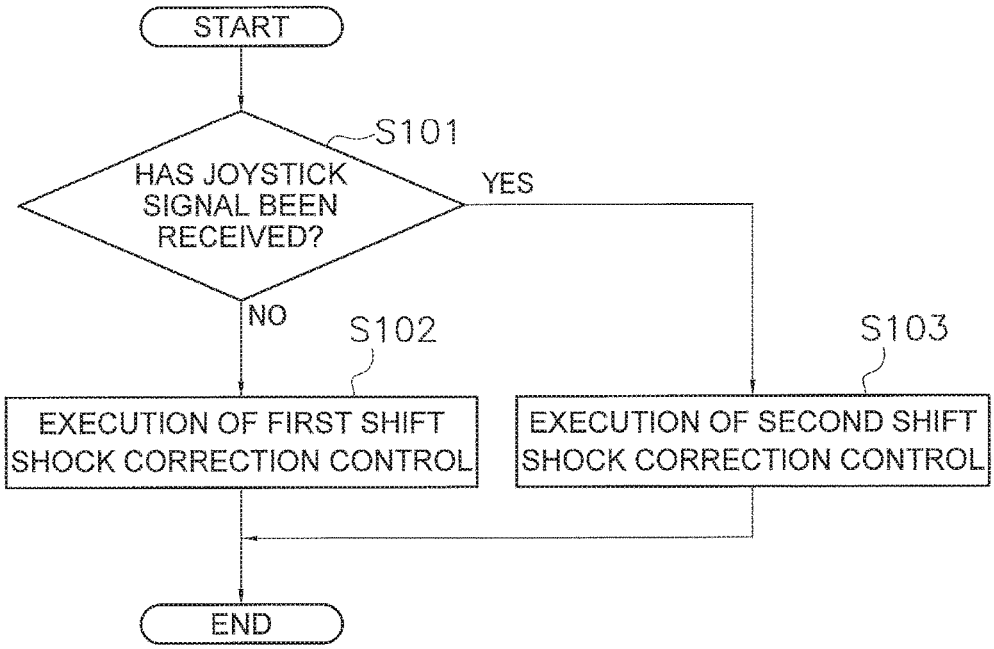
FIG. 5 is a flowchart showing a series of processes executed during shift shock correction control.

FIG. 5 is a flowchart showing a series of processes executed during shift shock correction control. As shown in FIG. 5, in step S101, the first engine controller 9*a* determines whether or not it has received the joystick signal. The first engine controller 9*a* determines that it has received the joystick signal when receiving the joystick signal that indicates the forward, rearward, rightward, or leftward tilt operation of the joystick 23, the twist operation of the joystick 23, or the operation to set the mode setting switch 24 to an on position. When the first engine controller 9*a* determines that it has not received the joystick signal yet, the process proceeds to step S102.

In step S102, the first engine controller 9*a* executes first shift shock correction control. In other words, the first engine controller 9*a* executes the first shift shock correction control when shifting between forward movement and rearward movement by the left outboard motor 1*a* in response to operation of the remote control 22. In the first shift shock correction control, the first engine controller 9*a* corrects the ignition timing of the engine 2*a* based on first shift shock correction data shown in FIG. 6A. The first shift shock correction data indicates a relationship between engine rotational speed and correction angle in ignition timing. With reference to the first shift shock correction data, the first engine controller 9*a* determines the correction angle in ignition timing in accordance with the engine rotational speed.

As shown in FIG. 6A, in the first shift shock correction data, the first engine controller 9*a* retards the ignition timing from the normal timing in a first engine rotational speed range R1. In the first shift shock correction data, the first engine controller 9*a* controls ignition at the normal timing without correcting the ignition timing in a higher engine rotational speed range than the first engine rotational speed range R1. The first engine controller 9*a* executes the first shift shock correction control in a predetermined low engine rotational speed range. For example, as shown in FIG. 6A, the first engine controller 9*a* executes the first shift shock correction control in a low engine rotational speed range from about 600 rpm to about 800 rpm, for example. However, the first shift shock correction control is not executed at an engine rotational speed less than an engine idling rotational speed. For example, the engine idling rotational speed could be a value within a range of about 500 rpm to about 700 rpm. It should be noted that the low engine rotational speed range, in which the first shift shock correction control is executed, is not limited to be about 600 rpm to about 800 rpm, and alternatively, may be another engine rotational speed range from, for instance, about 600 rpm to about 1000 rpm.

In step S101, when the first engine controller 9*a* determines that it has received the joystick signal, the process proceeds to step S103. In step S103, the first engine controller 9*a* executes second shift shock correction control. In other words, the first engine controller 9*a* executes the second shift shock correction control when shifting between forward movement and rearward movement by the left outboard motor 1*a* in response to operation of the joystick 23. More specifically, the first engine controller 9*a* executes the second shift shock correction control when any one of the fore surge mode, the aft surge mode, the sway mode, the bow turning mode, and the fixed spot keeping mode is selected by operating the joystick 23.

In the second shift shock correction control, the first engine controller 9*a* corrects the ignition timing of the engine 2*a* based on second shift shock correction data shown in FIG. 6B. Similarly to the first shift shock correction data, the second shift shock correction data indicates a relationship between engine rotational speed and correction angle in ignition timing. With reference to the second shift shock correction data, the first engine controller 9*a* determines the correction angle in ignition timing in accordance with the engine rotational speed. The second shift shock correction data is different from the first shift shock correction data.

As shown in FIG. 6B, in the second shift shock correction data, the first engine controller 9*a* retards the ignition timing from the normal timing in a second engine rotational speed range R2. The second engine rotational speed range R2 includes values of the engine rotational speed greater than those included in the first engine rotational speed range R1. In the second shift shock correction data, the first engine controller 9*a* controls ignition at the normal timing without correcting the ignition timing in a higher engine rotational speed range than the second engine rotational speed range R2. The first engine controller 9*a* executes the second shift shock correction control in a predetermined low engine rotational speed range, but not less than the engine idling rotational speed, as discussed above. For example, as shown in FIG. 6B, the first engine controller 9*a* executes the second shift shock correction control in a low engine rotational speed range from about 600 rpm to about 1300 rpm, for example. It should be noted that the low engine rotational speed range, in which the second shift shock correction control is executed, is not limited to be about 600 rpm to about 1300 rpm, and alternatively, may be another rotational speed range from, for instance, about 600 rpm to about 1500 rpm.

It should be noted that the numerical values shown in FIGS. 6A and 6B are exemplary only, and may be replaced by other numerical values. Preferred embodiments of the present invention are not limited in any way to the specific numerical values shown in FIGS. 6A and 6B.

In the watercraft operating system according to the present preferred embodiment, the second shift shock correction control, which is different from the first shift shock correction control executed when operating the remote control 22, is executed when operating the joystick 23. During the second shift shock correction control, ignition is made at an angle corresponding to a retarded timing in an engine rotational speed range higher than that during the first shift shock correction control. Accordingly, the engine rotational speed is reduced when shifting in response to operation of the joystick 23, such that shift shock is significantly reduced or prevented.

Preferred embodiments of the present invention have been explained above. However, the present invention is not limited to the above preferred embodiments, and a variety of changes can be made without departing from the gist of the present invention.

The number of outboard motors is not limited to two, and alternatively, may be one or may be greater than two. Various elements of the outboard motors 1*a* and 1*b* may be changed or omitted. Various controls may be changed or omitted.

In the above preferred embodiments, the second shift shock correction control is preferably executed for all the operating modes by the joystick 23. However, the second shift shock correction control may be executed for only a portion of the operating modes by the joystick 23.

Shift shock may be reduced or prevented by processes other than correction of the ignition timing of the engine. For example, each of the first and second engine controllers 9*a* and 9*b* may execute dashpot correction control. The dashpot correction control is a control that avoids engine stalling from occurring due to a shortage of the intake amount when the throttle opening degree of the engine 2*a*, 2*b* is rapidly reduced by operating the remote control 22 or the joystick 23.

During the dashpot correction control, each of the first and second engine controllers 9*a* and 9*b* causes the opening degree of the throttle valve 32*a*, 32*b* to be greater than an opening degree required in accordance with the operating amount of the remote control 22 or the joystick 23. Accordingly, the throttle intake amount is increased, such that the occurrence of engine stalling is prevented.

It should be noted that shift shock may become large when shifting between forward movement and rearward movement while the engine rotational speed is high during the dashpot correction control. In view of this, each of the first and second engine controllers 9*a* and 9*b* may reduce the shift shock by correcting the throttle intake amount during the dashpot correction control. The dashpot correction control executed by the first engine controller 9*a* will be hereinafter explained. However, the second engine controller 9*b* also executes a series of processes similar to that executed by the first engine controller 9*a*.

Figure 7:
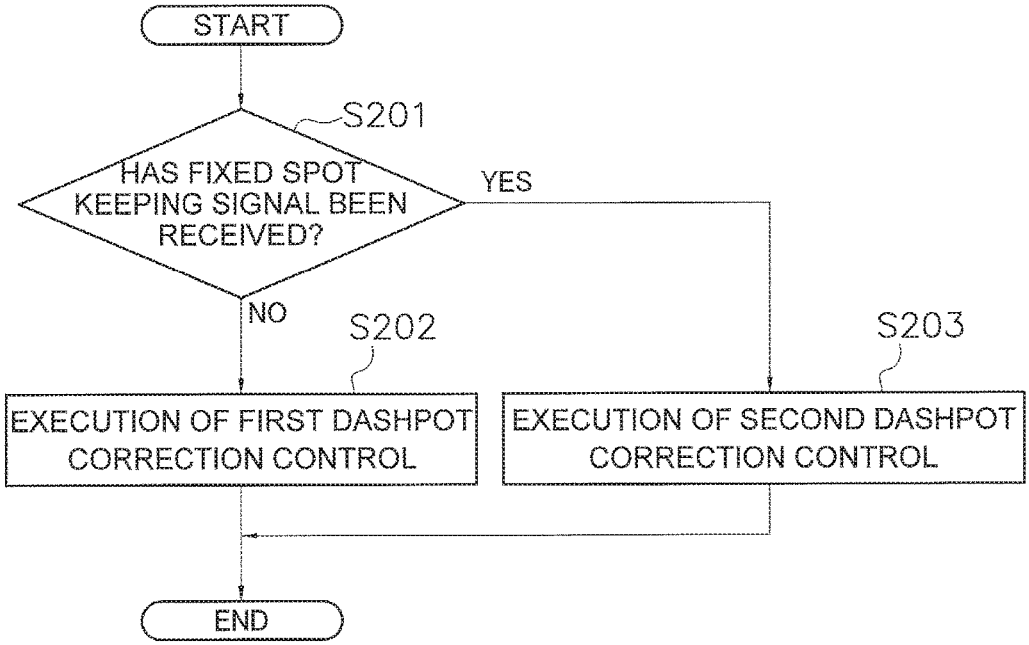
FIG. 7 is a flowchart showing a series of processes executed during dashpot correction control.

FIG. 7 is a flowchart showing a series of processes executed during the dashpot correction control. As shown in FIG. 7, in step S201, the first engine controller 9*a* determines whether or not it has received a fixed spot keeping signal, indicating that the fixed spot keeping mode has been turned on, from the mode setting switch 24. When the first engine controller 9*a* determines that it has not received the fixed spot keeping signal yet, the process proceeds to step S202.

In step S202, the first engine controller 9*a* executes first dashpot correction control. In other words, the first engine controller 9*a* executes the first dashpot correction control when the throttle opening degree has been reduced by operating the remote control 22. The first engine controller 9*a* may determine whether or not the throttle opening degree has been reduced based on, for instance, the signal received from the throttle opening degree sensor 33*a*.

In the first dashpot correction control, the first engine controller 9*a* corrects the throttle opening degree based on first dashpot correction data shown in FIG. 8A. The first dashpot correction data indicates relationships among the required opening degree, the engine rotational speed, and the increment in the throttle opening degree. The required opening degree is a throttle opening degree determined in accordance with the operating amount of the remote control 22. With reference to the first dashpot correction data, the first engine controller 9*a* determines the increment in the throttle opening degree in accordance with the required opening degree and the engine rotational speed. The first engine controller 9*a* determines a value obtained by adding the increment in the throttle opening degree to the required opening degree as a target throttle opening degree, and controls the throttle valve 32*a* based on the target throttle opening degree.

In step S201, when the first engine controller 9*a* determines that it has received the fixed spot keeping signal, the process proceeds to step S203. In step S203, the first engine controller 9*a* executes second dashpot correction control. In other words, when the fixed spot keeping mode is selected by operating the mode setting switch 24, the first engine controller 9*a* executes the second dashpot correction control.

In the second dashpot correction control, the first engine controller 9*a* corrects the throttle opening degree based on second dashpot correction data shown in FIG. 8B. Similarly to the first dashpot correction data, the second dashpot correction data indicates relationships among the required opening degree, the engine rotational speed, and the increment in the throttle opening degree. With reference to the second dashpot correction data, the first engine controller 9*a* determines the increment in the throttle opening degree in accordance with the required opening degree and the engine rotational speed.

The second dashpot correction data is different from the first dashpot correction data. More specifically, the increment in the throttle opening degree set based on the second dashpot correction data is less than that set based on the first dashpot correction data. For example, the first engine controller 9*a* generates the second dashpot correction data by multiplying respective values included in the first dashpot correction data by a predetermined coefficient. The predetermined coefficient is preferably a value less than 1.0, for example. In the example shown in FIGS. 8A and 8B, the predetermined coefficient is 0.8, for example. It should be noted that another value may be set as the predetermined coefficient.

It should be noted that the numerical values shown in FIGS. 8A and 8B are exemplary only, and may be replaced by other numerical values. The first engine controller 9*a* may perform the second dashpot correction data by multiplying a portion of the values included in the first dashpot correction data by a predetermined coefficient. The first engine controller 9*a* may include the second dashpot correction data arbitrarily set regardless of the values included in the first dashpot correction data. Only a portion of the values included in the second dashpot correction data may be less than the values included in the first dashpot correction data.

As described above, the second dashpot correction control, which is different from the first dashpot correction control executed when the throttle opening degree has been reduced by operating the remote control 22, may be executed when the throttle opening degree has been reduced by operating the mode setting switch 24.

In the second dashpot correction control, the increment in the throttle opening degree is reduced compared to that in the first dashpot correction control. Therefore, when the throttle opening degree has been reduced by operating the joystick 23, the engine rotational speed is lower than that when the throttle opening degree has been reduced by operating the remote control 22. Accordingly, shift shock is significantly reduced or prevented, and the occurrence of engine stalling is able to be prevented.

It should be noted that the first engine controller 9*a* may execute the second dashpot correction control when the throttle opening degree has been reduced in response to another type of operation by the joystick 23. More specifically, the first engine controller 9*a* may execute the second dashpot correction control when any of the fore surge mode, the aft surge mode, the sway mode, the bow turning mode, and the fixed spot keeping mode is selected by operating the joystick 23.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft operating system to operate a watercraft including an outboard motor, the watercraft operating system comprising:

a remote control that outputs a remote control signal to operate the outboard motor;

a joystick that outputs a joystick signal to operate the outboard motor; and a controller configured or programmed to receive the remote control signal from the remote control and the joystick signal from the joystick, the controller being further configured or programmed to:

control shifting between forward movement and rearward movement by the outboard motor in response to operation of the remote control and the joystick;

execute first shift shock correction control when shifting between forward movement and rearward movement by the outboard motor in response to operation of the remote control; and execute second shift shock correction control, different from the first shift shock correction control, when shifting between forward movement and rearward movement by the outboard motor in response to operation of the joystick.

2. The watercraft operating system according to claim 1, wherein the controller is further configured or programmed to:

execute the first shift shock correction control in a first engine rotational speed range;

execute the second shift shock correction control in a second engine rotational speed range; and the second engine rotational speed range includes at least one engine rotational speed greater than the first engine rotational speed range.

3. The watercraft operating system according to claim 1, wherein the controller is further configured or programmed to:

execute a sway mode to control the outboard motor to transversely move the watercraft in response to operation of the joystick; and execute the second shift shock correction control when the sway mode is selected.

4. The watercraft operating system according to claim 1, wherein the controller is further configured or programmed to:

execute a fixed spot keeping mode to control the outboard motor to keep the watercraft in a fixed position in response to operation of the joystick; and execute the second shift shock correction control when the fixed spot keeping mode is selected.

5. The watercraft operating system according to claim 1, wherein the controller is further configured or programmed to correct ignition timing of an engine in each of the first shift shock correction control and the second shift shock correction control.

6. The watercraft operating system according to claim 1, wherein the controller is further configured or programmed to correct a throttle intake amount of an engine in each of the first shift shock correction control and the second shift shock correction control.

7. The watercraft operating system according to claim 1, wherein the controller is further configured or programmed to:

execute the first shift shock correction control at an engine rotational speed from 600 rpm to 1,000 rpm; and execute the second shift shock correction control at an engine rotational speed from 600 rpm to 1,500 rpm.

8. A method executed by a controller to operate a watercraft including an outboard motor, the method comprising the steps of:

receiving a remote control signal to operate the outboard motor from a remote control;

receiving a joystick signal to operate the outboard motor from a joystick;

controlling shifting between forward movement and rearward movement by the outboard motor in response to operating the remote control and the joystick;

executing first shift shock correction control when shifting between forward movement and rearward movement by the outboard motor in response to operating the remote control; and executing second shift shock correction control, different from the first shift shock correction control, when shifting between forward movement and rearward movement by the outboard motor in response to operating the joystick.

9. The method according to claim 8, wherein the first shift shock correction control is executed in a first engine rotational speed range;

the second shift shock correction control is executed in a second engine rotational speed range; and the second engine rotational speed range includes at least one engine rotational speed greater than the first engine rotational speed range.

10. The method according to claim 8, further comprising the step of:

executing a sway mode to control the outboard motor to transversely move the watercraft in response to operating the joystick; wherein the second shift shock correction control is executed when the sway mode is selected.

11. The method according to claim 8, further comprising the step of:

executing a fixed spot keeping mode to control the outboard motor to keep the watercraft in a fixed position in response to operating the joystick; wherein the second shift shock correction control is executed when the fixed spot keeping mode is selected.

12. The method according to claim 8, wherein each of the first shift shock correction control and the second shift shock correction control includes correcting ignition timing of an engine.

13. The method according to claim 8, wherein each of the first shift shock correction control and the second shift shock correction control includes correcting a throttle intake amount of an engine.

14. The method according to claim 8, wherein the first shift shock correction control is executed at an engine rotational speed from 600 rpm to 1,000 rpm, and the second shift shock correction control is executed at an engine rotational speed from 600 rpm to 1,500 rpm.

* * * * *